US011560204B2

(12) United States Patent
Cardenas et al.

(10) Patent No.: US 11,560,204 B2
(45) Date of Patent: Jan. 24, 2023

(54) TECHNIQUES FOR PROVIDING VARIABLE BUOYANCY TO A DEVICE

(71) Applicant: Boston Engineering Corporation, Waltham, MA (US)

(72) Inventors: Robert Lee Cardenas, Framingham, MA (US); Michael Conry, Beverly, MA (US); Michael Rufo, Hanover, MA (US); Todd Scrimgeour, Brighton, MA (US)

(73) Assignee: Boston Engineering Corporation, Waltham, MA (US)

( * ) Notice: Subject to any disclaimer, the term of this patent is extended or adjusted under 35 U.S.C. 154(b) by 129 days.

(21) Appl. No.: 17/122,527

(22) Filed: Dec. 15, 2020

(65) Prior Publication Data

US 2021/0179234 A1 Jun. 17, 2021

Related U.S. Application Data

(60) Provisional application No. 62/959,513, filed on Jan. 10, 2020, provisional application No. 62/948,514, filed on Dec. 16, 2019.

(51) Int. Cl.
*B63B 22/20* (2006.01)
*B63B 79/40* (2020.01)

(52) U.S. Cl.
CPC ..... *B63B 22/20* (2013.01); *B63B 79/40* (2020.01)

(58) Field of Classification Search
CPC ..... B63B 22/00; B63B 22/12; B63B 22/18; B63B 22/20; B63B 22/24; B63B 79/00; B63B 79/40; B63B 2211/02
USPC ..... 441/1, 21, 28, 29
See application file for complete search history.

(56) References Cited

U.S. PATENT DOCUMENTS

| | | | | |
|---|---|---|---|---|
| 3,171,376 | A | 3/1965 | Michael et al. | |
| 3,818,523 | A | 6/1974 | Stillman | |
| 3,906,565 | A | 9/1975 | Dorrance et al. | |
| 5,460,556 | A * | 10/1995 | Logan | B63B 22/18 441/32 |
| 6,309,269 | B1 * | 10/2001 | Fulton | B63B 21/22 441/6 |
| 6,772,705 | B2 | 8/2004 | Leonard et al. | |
| 6,807,856 | B1 | 10/2004 | Webb | |
| 6,916,219 | B2 * | 7/2005 | Tokhtuev | G01N 1/14 441/29 |
| 8,397,658 | B1 | 3/2013 | Imlach et al. | |
| 9,272,756 | B1 * | 3/2016 | Thomson | B63B 22/18 |
| 10,569,839 | B1 * | 2/2020 | Thomson | B63B 22/12 |
| 2014/0047682 | A1 | 2/2014 | Blackman et al. | |

(Continued)

FOREIGN PATENT DOCUMENTS

| | | |
|---|---|---|
| RU | 2609849 | 2/2017 |
| WO | 2012013962 | 2/2012 |
| WO | 2018067738 | 4/2018 |

*Primary Examiner* — Daniel V Venne
(74) *Attorney, Agent, or Firm* — BainwoodHuang

(57) ABSTRACT

A variable buoyancy device has an inner region and an outer cavity. The outer cavity extends at least partially around the inner region and is adapted to contain fluids, such as a liquid and a gas, the relative proportions of which can be varied to vary buoyancy. The inner region provides an advantageous location for equipment, while the outer cavity provides a significant volume for achieving a wide range of buoyancy adjustments.

20 Claims, 6 Drawing Sheets

(56) References Cited

U.S. PATENT DOCUMENTS

| | | | |
|---|---|---|---|
| 2017/0227638 | A1 | 8/2017 | Nicoletti et al. |
| 2018/0162501 | A1 | 6/2018 | Peterson et al. |

* cited by examiner

TECHNIQUES FOR PROVIDING VARIABLE BUOYANCY TO A DEVICE

CROSS-REFERENCE TO RELATED APPLICATIONS

This application claims the benefit of U.S. Provisional Application No. 62/948,514, filed Dec. 16, 2019, the contents and teachings of which are incorporated herein by reference. This application also claims the benefit of U.S. Provisional Application No. 62/959,513, filed Jan. 10, 2020, the contents and teachings of which are incorporated herein by reference.

STATEMENT REGARDING FEDERALLY SPONSORED RESEARCH OR DEVELOPMENT

This invention was made with government support under WC-133R-15-CN-0112 awarded by the National Oceanic and Atmospheric Administration. The government has certain rights in the invention.

BACKGROUND

Changing the buoyancy of an apparatus within a fluid, such as water or air, has long been a necessary activity in many areas, such as maritime and aviation technologies. Submarines, air balloons, dirigibles, and the like use ballasts, hot air, compressed gas, hydrogen, and/or helium to vary altitude in the atmosphere or depth within water. For maritime uses, gases such as helium, hydrogen, and carbon dioxide may be stored in compressed form, e.g., in storage tanks or cartridges, and released to lower-pressure states as needed to increase buoyancy.

A sonde is a submersible apparatus that can travel up and down within a body of water and make measurements, such as measurements of temperature, pressure, and/or salinity. A sonde may travel up and down at numerous locations, in a process called "profiling." A conventional sonde may include a centrally-located tank, such as a bladder, which is adapted to hold both water (or other liquid) and gas. To make the sonde sink, the tank is filled with water. To make the sonde rise, the tank is filled with gas.

SUMMARY

Unfortunately, the central tank of the above-described sonde tends to consume significant interior volume. Also, the central location of the tank can impose constraints and/or restrictions on the placement of other onboard equipment. Accordingly, the conventional sonde may require customized frames, housings, awkwardly located equipment, inefficiently packaged or implemented electrical systems, etc., depending on the specific type of application and/or use. For some situations, the central location of the tank may even make the sonde unsuitable for use.

In contrast with the above-described conventional sonde, improved techniques involve the use of a variable buoyancy device having an inner region and an outer cavity. The outer cavity extends at least partially around the inner region and is adapted to contain fluids, such as a liquid and a gas, the relative proportions of which can be varied to vary buoyancy. The inner region provides an advantageous location for equipment, while the outer cavity provides a significant volume for achieving a wide range of buoyancy adjustments. The improved techniques enable the variable buoyancy device to have a non-intrusive form factor (e.g., a slim or streamline body) with gas and/or liquid held efficiently in the outer cavity outside the inner region.

Certain embodiments are directed to a variable buoyancy device. The device includes an inner region, configured to at least partially contain equipment, and an outer cavity that extends at least partially around the inner region and is separated from the inner region by a set of walls. The device further includes a set of valves and a controller coupled to the set of valves. The controller is constructed and arranged to activate the set of valves to establish a first combination of a first fluid and a second fluid in the outer cavity, the first combination providing the device with a first buoyancy condition. The controller is further constructed and arranged to reactivate the set of valves to establish a second combination of the first fluid and the second fluid in the outer cavity, the second combination providing the device with a second buoyancy condition. The first fluid and the second fluid have different relative buoyancies.

In some arrangements, the set of valves includes a first valve coupled between the outer cavity and an environment of the device, where the first fluid is obtained from the environment of the device, and a second valve coupled between the outer cavity and a source of the second fluid.

In some arrangements, the first fluid comprises a liquid and the second fluid comprises a gas.

In some arrangements, the source of the second fluid includes a container of compressed gas.

In some arrangements, the outer cavity extends at least partially along the device lengthwise and at least partially around the device transversely.

In some arrangements, the outer cavity has a closed top and an open bottom open to the environment of the device.

In some arrangements, the outer cavity includes a first region and a second region that provide respective enclosed spaces. The first region and the second region are configured to contain respective combinations of the first fluid and the second fluid.

In some arrangements, the set of valves is configured to independently control the respective combinations in the first region and the second region.

In some arrangements, the first region is external to the second region and is larger in volume than the second region.

In some arrangements, the outer cavity has an annular cross-section over at least a portion of its length, and the first region and the second region are separated at least in part by a cylindrical wall within the outer cavity.

In some arrangements, the container of compressed gas is at least partially disposed in the inner region as equipment of the device.

Other embodiments are directed to a sonde that includes multiple modules arranged end-to-end. The modules include a variable buoyancy module, such as the variable buoyancy module described above.

Still other embodiments are directed to a method of changing buoyancy of a device. The method includes deploying the device in a body of water, the device having (i) an inner region configured to at least partially contain equipment and (ii) an outer cavity that extends at least partially around the inner region and is separated from the inner region by a set of walls. The method further includes activating a set of valves to establish a first combination in the outer cavity of a first fluid and a second fluid, the first combination providing the device with a first buoyancy condition that brings the device to a first level within the body of water. The first fluid and the second fluid have different buoyancies. After the device has operated with the first buoyancy condition for a period of time, the method still further includes reactivating the set of valves to establish a second combination in the outer cavity of the first fluid and the second fluid, the second combination providing the device with a second buoyancy condition that brings the device to a second level, different from the first level, within the body of water.

In some arrangements, the first fluid is water provided from the body of water, and activating the set of valves causes a volume of water from the body of water to enter the outer cavity.

In some arrangements, the second fluid is gas provided from a container of compressed gas, and reactivating the set of valves causes a quantity of gas from the container to enter the outer cavity and a quantity of water to be displaced from the outer cavity.

In some arrangements, the outer cavity includes first and second regions that provide respective enclosed spaces, and the method further includes: establishing a ballast setting of the device by providing a set combination of water and gas in the first region of the outer cavity; and varying a depth of the device in the body of the water by varying a combination of water and gas in the second region of the outer cavity while maintaining constant the set combination of water and gas in the first region.

In some arrangements, providing the set combination includes establishing neutral buoyancy of the device in the body of water.

In some arrangements, providing the set combination includes introducing water into the first region by: opening a first valve coupled between the first region and the body of water; and opening a second valve coupled between an upper portion of the first region and the body of water.

In some arrangements, establishing the ballast setting of the device includes introducing gas into the first region by: opening a first valve coupled between the first region and the body of water; and opening a third valve coupled between the first region and the container of compressed gas.

In some arrangements, varying the depth of the device further includes increasing the buoyancy of the device by: opening a fourth valve coupled between a lower portion of the second region and the body of water; and opening a fifth valve coupled between the second region and the container of compressed gas. Opening the fourth valve and the fifth valve displaces a volume of water in the second region with a volume of gas.

In some arrangements, varying the depth of the device includes decreasing the buoyancy of the device by: opening the fourth valve; and opening a sixth valve coupled between the second region and the body of water. Opening the fourth valve and the sixth valve displaces a volume of gas in the second region with a volume of water.

The foregoing summary is presented for illustrative purposes to assist the reader in readily grasping example features presented herein; however, this summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE SEVERAL VIEWS OF THE DRAWINGS

The foregoing and other features and advantages will be apparent from the following description of particular embodiments, as illustrated in the accompanying drawings, in which like reference characters refer to the same or similar parts throughout the different views. The drawings are not necessarily to scale, emphasis instead being placed upon illustrating the principles of various embodiments.

DETAILED DESCRIPTION

Embodiments of the improved techniques will now be described. One should appreciate that such embodiments are provided by way of example to illustrate certain features and principles but are not intended to be limiting.

Improved techniques are directed to a variable buoyancy device having an inner region and an outer cavity. The outer cavity extends at least partially around the inner region and is adapted to contain fluids, such as a liquid and a gas, the relative proportions of which can be varied to vary buoyancy. The inner region provides an advantageous location for equipment, while the outer cavity provides a significant volume for achieving a wide range of buoyancy adjustments.

Figure 1:
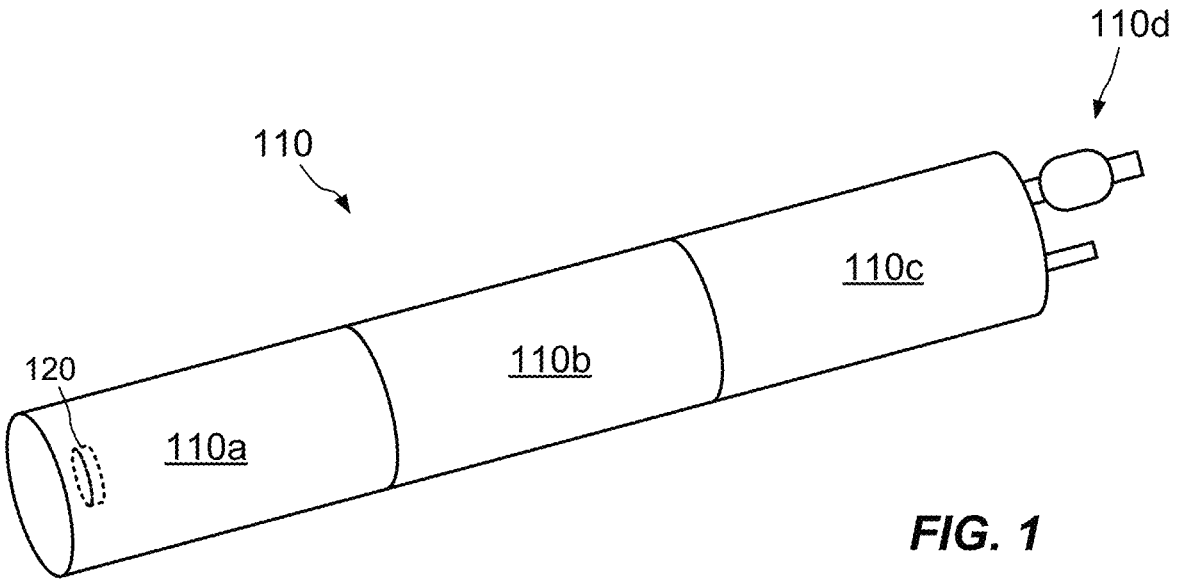
FIG. 1 is a block diagram of an example sonde with which embodiments of the improved techniques can be practiced.

FIG. 1 shows an example sonde 110 with which embodiments of the improved techniques can be practiced. The sonde 110 is seen to include multiple modules, e.g., modules 110*a*, 110*b*, and 110*c*, which are arranged end-to-end. For example, module 110*a* is a sensor module, module 110*b* is a variable buoyancy module, and module 110*c* is an electronics or parachute module. Although a variable buoyancy module 110*b* is assumed to be present in all disclosed embodiments, other types of modules may be used in place of or in addition to the modules 110*a* and 110*c*, such as a battery module, a communications module, or other types of modules.

In an example, the sonde 110 is deployable from an aircraft over a body of water, such as an ocean, lake, river, sea, or the like. For instance, the sonde 110 is dropped from an aircraft and releases a parachute (not shown). Upon splashdown, the sonde detaches from the parachute and prepares for profiling, i.e., repetitively descending and rising within the body of water. A weight 120 may be placed within the bottom-most module (e.g., 110*a*), to keep the sonde 110 in an upright orientation in the water. While profiling, instrumentation within the sonde 110 typically makes measurements of the environment, such as temperature, pressure, salinity, and the like, and stores the measurements internally, e.g., in computer memory or non-volatile storage, such as a magnetic disk drive or electronic flash drive. When the sonde eventually surfaces, it may transmit the measurements wirelessly to a base station, which may be located on a ship, on an aircraft, or on land, for example.

In order to efficiently profile within the body of water, the sonde 110 preferably varies its own buoyancy, e.g., by decreasing its buoyancy to sink and increasing its buoyancy to rise. In the illustrated example, the role of varying the buoyancy of the sonde 110 is performed by the variable buoyancy module 110*b*.

Figure 2:
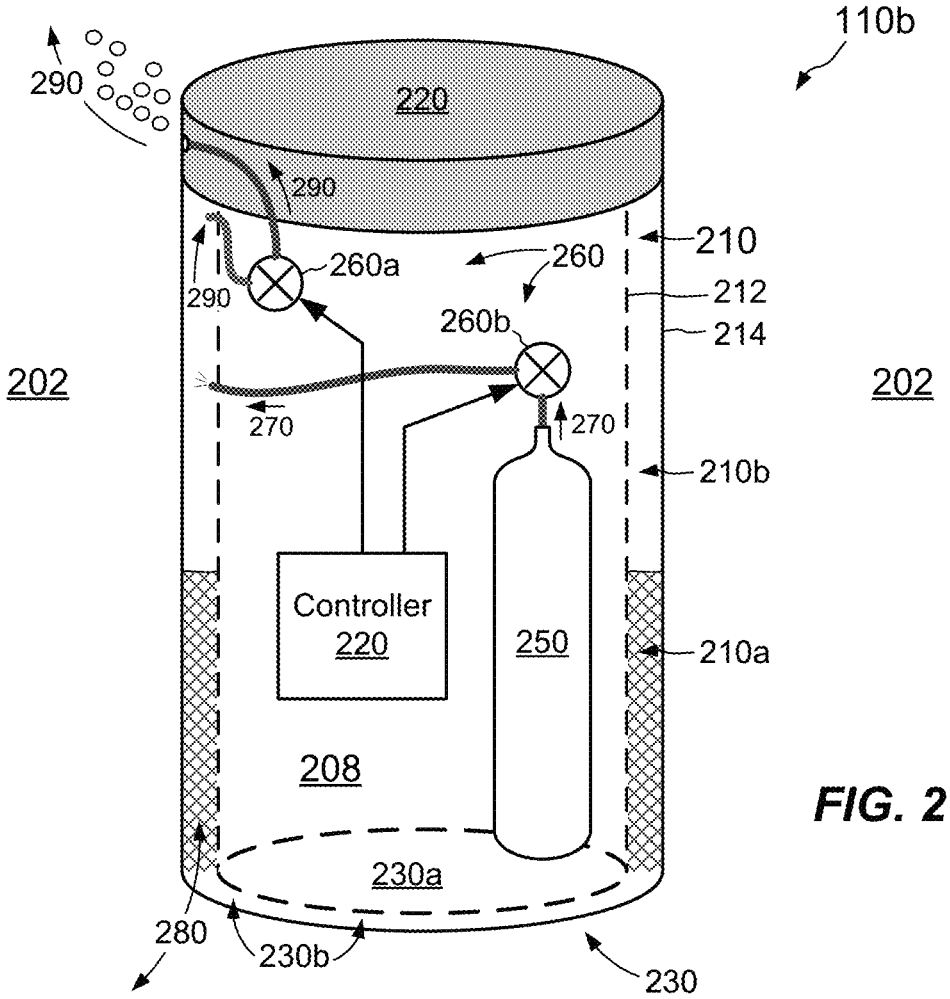
FIG. 2 is a schematic view of an example variable buoyancy device in accordance with one embodiment.

FIG. 2 shows a first example of a variable buoyancy device 200 according to certain embodiments. The variable buoyancy device 200 may constitute the variable buoyancy module 110*b* or only a portion thereof. As shown, the variable buoyancy device 200 includes an inner region 208 and an outer cavity 210. A set of walls, such as wall 212, separates the inner region 208 from the outer cavity 210. The outer cavity 210 also has an external wall 214. The inner region 108 may be configured to at least partially house various equipment, such as a controller 220 (e.g., a microcontroller and/or other electronic control circuitry), a container 250 of compressed gas (such as CO2), and various valves 260. A first valve 260*a* is coupled between and upper portion of the outer cavity 210 and an environment 202 of the sonde 110, such as a body of water or other liquid that surrounds the sonde 110 (Water is assumed going forward, but it is understood that embodiments are not limited to use in water). A second valve 260*b* is coupled between the container 250 and the outer cavity 210. The illustrated tubes may be used to conduct fluids through the indicated paths 270 and 290. One or more manifolds may also be used for this purpose.

In the illustrated example, the inner region 208 is preferably enclosed, so that no gas or water may enter or exit. One or more airtight, watertight ports (not shown) may be provided to facilitate service of equipment within the inner region 208.

The variable buoyancy device 200 is seen to have a closed top 220 and a partially open bottom 230. The top 220 preferably forms an airtight and watertight seal with the walls 212 and 214, such that the outer cavity 210 may contain a volume of gas and water when the variable buoyancy device 200 is submerged and oriented upright (as shown). The bottom 230 of the variable buoyancy device 200 has a closed region 230*a*, which forms a bottom of the inner region 208, and an open region 230*b*, which forms a passageway between the environment 202 and the outer cavity 210. Thus, the top of the outer cavity 210 is closed while the bottom of the outer cavity 210 is open, allowing water 210*a* to freely enter and exit the outer cavity 210. The amount of water 210*a* in the outer cavity 210 may be limited by the volume of gas 210*b* contained in the outer cavity 210.

The variable buoyancy device 200 preferably has a rigid construction, with walls 212 and 214, top 220, and bottom 230*a* made of one or more rigid materials, such as aluminum and/or CPVC (chlorinated polyvinyl chloride). Other materials may also be used, once due consideration is given to cost, rigidity, tolerance to water, and weight. For example, the materials should not be so dense that excessive amounts of gas are required to lift the sonde 110 within water.

In example operation, the variable buoyancy device 200 begins a profiling cycle by reducing its buoyancy. For instance, the controller 220 activates valve 260*a* to open and valve 260*b* to close (both valves 260 may be normally-closed). Ambient water pressure then causes water 210*a* to enter the outer cavity 210 via path 280 at the bottom portion 230*b* while gas 210*b* within the outer cavity 210 begins to escape via path 290 into the environment 202, e.g., surrounding water.

It may not be necessary or desirable to evacuate all gas 210*b* from the outer cavity 210. Rather, in some examples the controller 220 opens the valve 260*a* in timed pulses, with each pulse releasing an increment of gas. The controller 220 may repeat this pulsing until the sonde 110 begins to descend, or until the sonde 110 achieves a desired rate of descent.

As a result of activating the valves 260 in the manner described, the variable buoyancy device 200 achieves a first buoyancy condition based on a first combination of water 210*a* (a first fluid) with gas 210*b* (a second fluid). Water has lower buoyancy than gas, and thus increasing the amount of water relative to the amount of gas in the outer cavity 210 has the effect of decreasing the buoyancy of the variable buoyancy device 200 and thus of the sonde 110 as a whole.

As the sonde 110 sinks, it may make numerous measurements of depth, temperature, salinity, and the like. The sonde 110 may store the measurements internally.

Once the sonde 110 has reached a desired depth, controller 220 may stop or reverse the descent by releasing an amount of gas from container 250 into the outer cavity 210. To this end, controller 220 reactivates the valves by opening valve 260*b* and closing valve 260*a*, which may already be closed. Gas 210*b* then enters the outer cavity 210, via path 270. As gas enters, the volume of gas 210*b* in the outer cavity 210 increases, causing a volume of water 210*a* to escape from the open bottom 230*b* into the environment, via path 280. As before, the controller 220 may use timed pulses, accumulating gas 210*b* in the outer cavity 210 until descent is stopped, or until a desired rate of ascent is achieved. The variable buoyancy device 200 thus assumes a second buoyancy condition based on a second combination of water 210*a* with gas 210*b*.

In some examples, the controller 220 may allow the sonde 110 to descend to a set depth, and to remain at this depth for a period of time before rising. A reason to descend and maintain depth is to ensure that the sonde falls below a level at which sunlight can typically reach. Maintaining depth in this manner can prevent biofouling, which can have an adverse effect on sonde operation. When it is time to ascend, the controller 220 may continue as before, i.e., by opening valve 260*b* (with valve 260*a* still closed). The sonde 110 may make additional measurements while it is rising.

The sonde 110 may perform numerous profiling cycles in this manner, falling and rising through the water based on operation of the controller 220 to activate the valves 260 as described. After each cycle, or after some number of cycles, the sonde 110 may rise to the surface and transmit its measurements to a base station. At the end of its mission, the sonde 110 may be retrieved. It may alternatively be scuttled, i.e., allowed to sink to the bottom of the body of water. The controller 220 may scuttle the sonde 110 by opening both valves 260 and keeping them open, e.g., until the container 250 runs out of compressed gas and the sonde 110 sinks to the bottom under its own weight.

The variable buoyancy device 200 thus embodies an efficient and cost-effective design for profiling a sonde in water while assuming a convenient form factor. It provides an ample inner region 208 for housing equipment and uses portions outside the inner region 208 to contain fluids for effecting buoyancy changes. The variable buoyancy device 200 thus provides a versatile platform that is suitable for many types of missions and applications.

We have recognized that the variable buoyancy device 200 works best for shorter missions, however. For example, the small size of the container 250 may support a limited number of profiling cycles, which may be further limited if the sonde is expected to descend very deeply. Also, the open bottom 230*b* of the outer cavity 210 makes the device 200 susceptible to a positive feedback loop, in which gas 210*b* in the outer cavity 210 becomes progressively more compressed as the sonde 110 descends, causing buoyancy to decrease more and more the deeper the sonde goes. Greater and greater amounts of gas may thus be required to stop the descent, or to enable the sonde 110 to rise. In addition, gas 210*b* can sometimes escape from the outer cavity 210 unexpectedly, e.g., if the sonde 110 tips over. Further, we have found that the variable buoyancy device 200 may, in some circumstances, consume large amounts of gas just to maintain neutral buoyancy.

Figure 3:
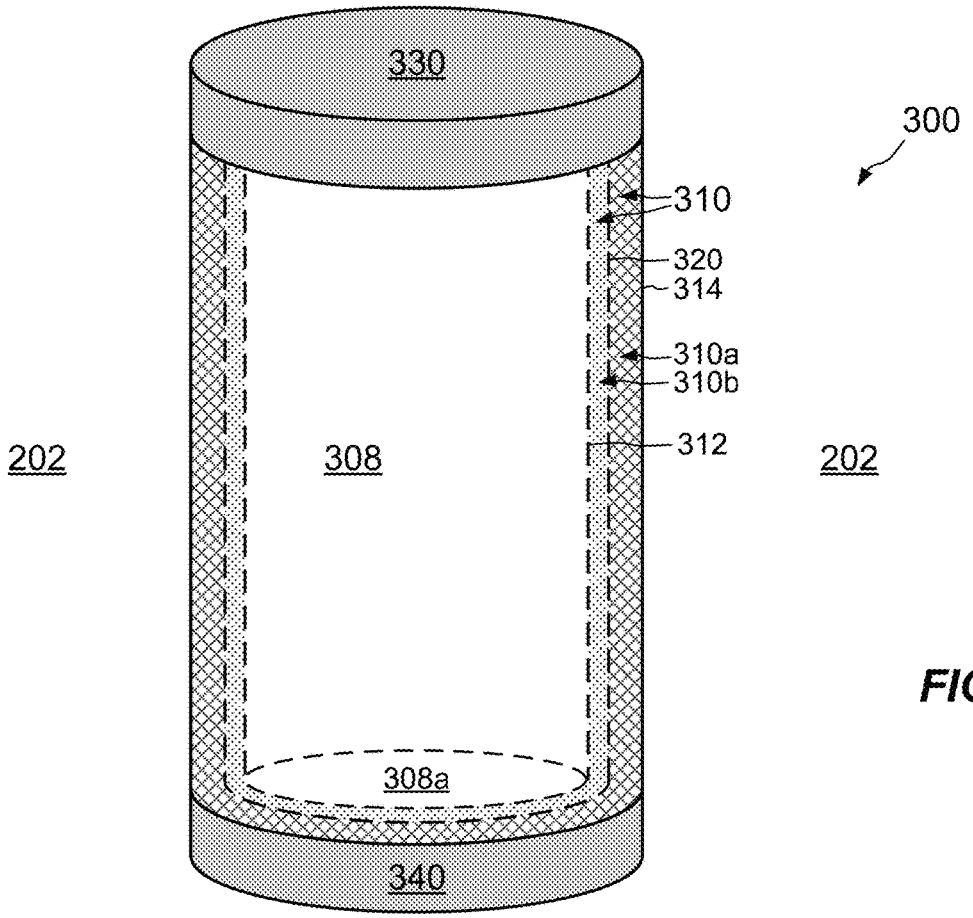
FIG. 3 is a schematic view of an example variable buoyancy device in accordance with another embodiment.

FIG. 3 shows an alternative variable buoyancy device 300 which at least in part addresses the above-described issues. The variable buoyancy device 300 may be used as a replacement for the variable buoyancy device 200 in the sonde 110 and may operate in a manner similar to that described above, but with marked improvements in regard to management of gas.

Like the variable buoyancy device 200, the variable buoyancy device 300 has an inner region 308 surrounded at least in part by an outer cavity 310. Wall 312 separates the inner region 308 from the outer cavity 310, and wall 314 forms an outside wall of the outer cavity 310. The variable buoyancy device 300 also has a closed top 330, which is both airtight and watertight. Materials may be similar to those described above, with aluminum and/or CPVC being favorable options for use for walls, top, and bottom.

Unlike the variable buoyancy device 200, the outer cavity 310 of the variable buoyancy device 300 has a closed bottom 340, which may be both airtight and watertight. Thus, other than by operation of valves (described infra.), the outer cavity 310 forms an enclosed space from which gas and water can neither enter nor escape. Also, the outer cavity 310 has a rigid construction that does not substantially deform as the sonde sinks. The rigid, closed outer cavity 310 thus allows ambient water pressure to have little or no effect on any gas held in the outer cavity 310. Gas therefore does not tend to compress more and more as the sonde sinks deeper and deeper in the water, and the above-described positive feedback loop is disrupted. For any given combination of water 210*a* with gas 210*b*, buoyancy of the variable buoyancy device 300 tends to remain constant with changing depth. The closed design also prevents the accidental loss of gas if the sonde tips over.

Also unlike the variable buoyancy device 200, where the inner region 208 has a closed bottom 230*a*, the inner region 308 of the variable buoyancy device 300 preferably has an open bottom 308*a*. The open bottom 308*a* may be arranged to allow entry of equipment, such as a large tank of compressed gas.

The variable buoyancy device 300 also differs from the device 200 in that it contains a wall 320 that divides the outer cavity 310 into two separate regions, a first region 310*a* and a second region 310*b*. Each of the regions 310*a* and 310*b* is separately enclosed and is individually airtight and watertight. Each region 310*a* or 310*b* can thus contain a respective combination of water with gas, independent of the combination in the other region. In the example shown, the first region 310*a* forms a ballast tank and the second region 310*b* forms a profile tank.

We have observed that most of the volume of the outer cavity 310 is needed for achieving neutral buoyancy (neither sinking nor rising), whereas a relatively small volume is needed for profiling. This is especially the case for long missions. For example, a large mass of compressed gas is typically needed to support long missions with many profiling cycles. But a large mass of compressed gas requires a large amount of expelled gas in the outer cavity 310 to achieve neutral buoyancy. The relative sizes of the ballast tank 310*a* and the profile tank 310*b* reflect this condition, with the ballast tank 310*a* typically being larger in volume than the profile tank 310*b* (e.g., twice as large, five times as large, ten times as large, etc.). In the example shown, the variable buoyancy device 300 may use the ballast tank 310*a* primarily or exclusively for establishing neutral buoyancy and may use the profile tank 310*b* primarily or exclusively for profiling.

By closing the outer cavity 310 and separating the ballast tank 310*a* from the profile tank 310*b*, the variable buoyancy device 300 makes efficient use of gas, which makes the variable buoyancy device 300 especially suitable for long missions involving many profiling cycles, as well as for missions requiring the sonde to descent to great depths.

Figure 4:
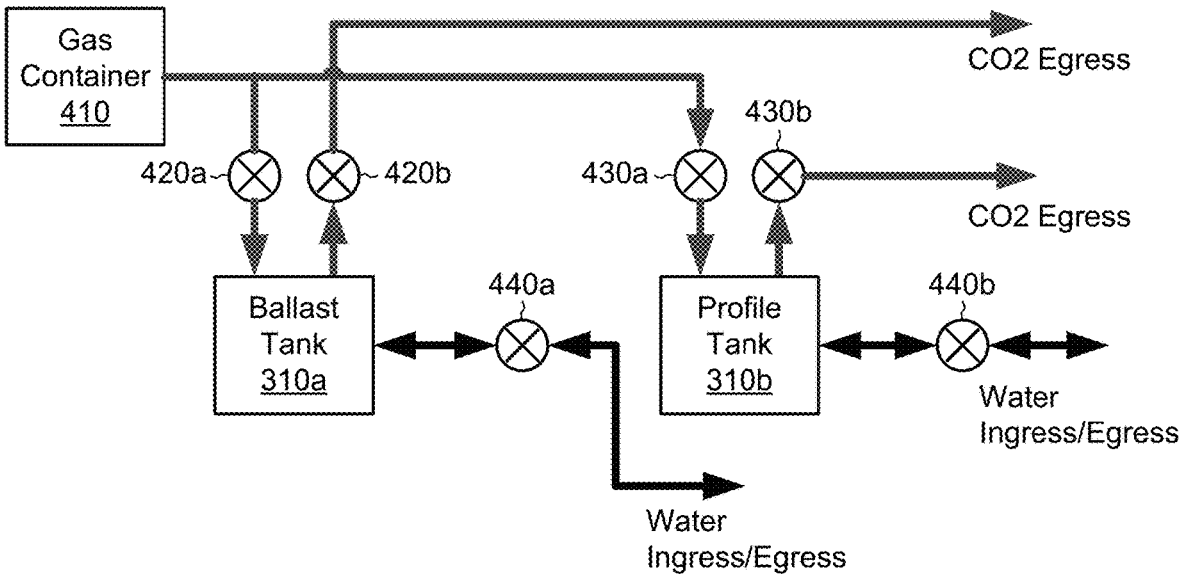
FIG. 4 is a schematic diagram of an example arrangement of valves in the embodiment of FIG. 3.

FIG. 4 shows an example arrangement of valves that may be used with the variable buoyancy device 300 of FIG. 3. As shown, the ballast tank 310*a* and the profile tank 310*b* are each coupled directly to three valves: one for gas ingress from a container 410, such as a CO2 tank; one for gas egress to the environment 202; and one for egress or ingress of water to and from the environment 202. The valves may be opened and closed by operation of controller 220, which may reside in the inner region 308 or elsewhere in the sonde 110.

For managing the ballast tank 310*a*, valves 420*a* and 420*b* respectively support ingress and egress of gas, and valve 440*a* supports ingress and egress of water. To increase buoyancy in the ballast tank 310*a*, valves 420*a* and 440*a* are opened and valve 420*b* is closed, causing compressed gas to enter the ballast tank via valve 420*a* and an equal volume of water to be forced out into the environment 202, via valve 440*a*. To decrease buoyancy in the ballast tank 310*a*, valves 420*b* and 440*a* are opened and valve 420*a* is closed, causing gas to escape the ballast tank 310*a* via valve 420*b* and an equal volume of water to enter the ballast tank 310*a* from the environment 202, via valve 440*a*.

The profile tank 310*b* works in a similar way. Valves 430*a* and 430*b* respectively support ingress and egress of gas, and valve 440*b* supports ingress and egress of water. To increase buoyancy, valves 430*a* and 440*b* are opened and valve 430*b* is closed. To decrease buoyancy, valves 430*b* and 440*b* are opened and valve 430*a* is closed.

The ballast tank 310*a* and the profile tank 310*b* are thus independently controllable, such that each may assume its own combination of water and gas, regardless of that of the other tank. As before, gas may be conducted using tubes and/or manifolds.

Figure 5:
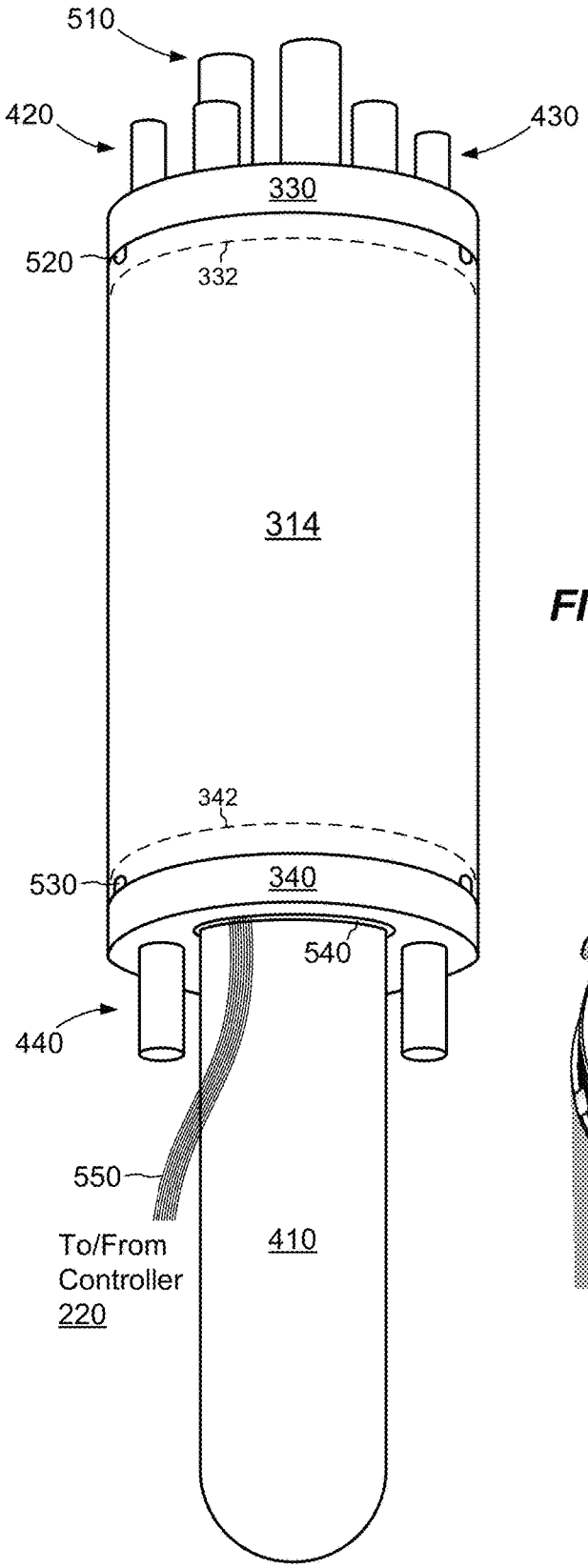
FIG. 5 is a lower-front view of the example variable buoyancy device of FIG. 3.
Figure 6:
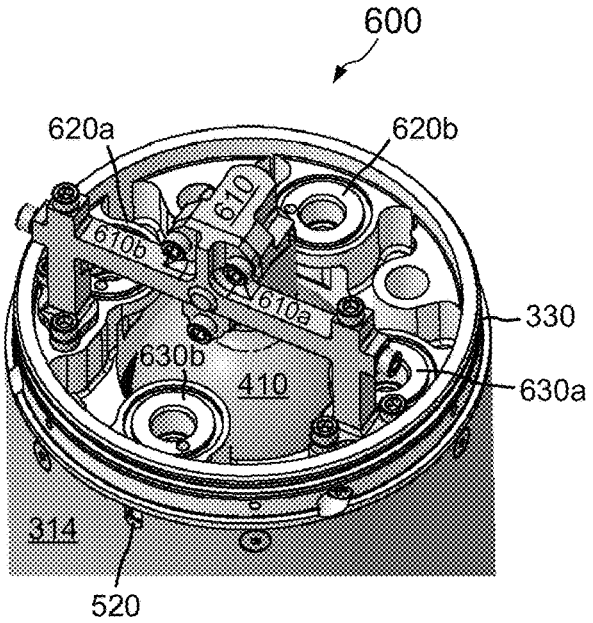
FIG. 6 is a partial top-front view of the example variable buoyancy device of FIG. 3.

FIG. 5 shows an example variable buoyancy device 300 in a more configured state, with FIG. 6 showing example details of a manifold 600 formed within the top piece 330. In FIG. 5, the container 410 of compressed gas is shown inserted into the inner region 308 via the opening 308*a* and extending out a central hole in the bottom piece 340. The container 410 terminates at the top of the manifold 600, where gas from the container 410 may flow into the manifold 600. Valves 420 and 430 (420*a*, 420*b*, 430*a*, and 430*b*) and pressure sensors 510 attach to the top piece 330 of the variable buoyancy device 300, while valves 440 (440*a* and 440*b*) attach to the bottom piece 340. A small space 540 may be provided between the central hole of the bottom piece 340 and the container 410 to allow for passage of a cable 550, such as a ribbon cable, which may convey signals and/or measurements to the controller 220, which may be located in a different module, for example.

The placement of gas-conducting valves 420 and 430 at the top piece 330 allows gas to easily enter and exit at the top, where gas will naturally collect. Likewise, the placement of the water-conducting valves 440 at the bottom piece 340 easily allows water to enter and exit from the bottom. The manifold 600 preferably includes channels (not shown) for conducting gas. A simpler manifold may be formed in the bottom piece 340 and may include channels for conveying water.

To support gas ingress into the outer cavity 310, the manifold 600 includes a receiver 610 that connects to an outlet of the gas container 410 (FIG. 6). Hollow arms 610*a* and 610*b* extend from the receiver 610 for allowing compressed gas to conduct from the receiver 610 into the manifold 600. Channels (not shown) within the manifold 600 distribute the gas to valve adapters 620*a* and 630*a*, which form airtight seals with respective valves 420*a* and 430*a* when the valves are attached. Each valve may have two ports (e.g., input and output), and each valve adapter includes a channel for each port.

In an example, the receiver 610 includes a blade or other protrusion that pierces the opening of the container 410 when the container is inserted, allowing compressed gas to exit the container. The flow of gas from the container 410 is normally blocked when the valves 420*a* and 430*a* are closed, but gas selectively flows when one or both of these valves are opened. For example, opening valve 420*a* causes gas to flow into the ballast tank 310*a*, via a channel formed within the manifold 600 between the valve adapter 620*a* and the ballast tank 310*a*. Such a channel may exit into the ballast tank 310*a* via an opening in the manifold 600 in a space between the walls 320 and 314 (FIG. 3). Likewise, opening valve 430*a* causes gas to flow into the profile tank 310*b*, via a similar channel formed between the valve adapter 630*a* and the profile tank 310*b*. Such a channel may exit into the profile tank 310*a* via an opening in the manifold between the walls 320 and 312.

To support gas egress from the tanks 310*a* and 310*b* into the environment 202 and avoid corrosion, valves 420*b* and 430*b* are respectively attached, via airtight connections, to valve adapters 620*b* and 630*b*. Additional channels connect the valve adapters 620*b* and 630*b* to the tanks 310*a* and 310*b*, respectively. For example, a channel from valve adapter 620*b* may open into the ballast tank 310*a* via an aperture in the manifold between walls 320 and 314, while a channel from valve adapter 630*b* may open into the profile tank between walls 320 and 312. When either of the valves 420*b* and 430*b* is opened, gas from the respective tank flows out through the respective valve and out an aperture 520 into the environment 202.

Although the illustrated apertures 520 are formed within the wall 314, one should note that apertures 520 do not breach the ballast tank 310*a*. Rather, the top piece 330 may extend partly inside the wall 314, e.g., down to line 332, such that the apertures 520 are disposed above the tank 310*a* and prevent leakage. In some examples, O-rings are placed between walls 320, 314, and 312 and the top piece 330 to form airtight and watertight seals. A similar arrangement may be used with the bottom piece 340, which can also be seen to extend inside the wall 314, up to line 342.

The manifold in the bottom piece 340 may be similar to the manifold 600 but is simpler, as it need only include two valve adapters for accommodating valves 440*a* and 440*b*. A first pair of channels may be formed in the bottom manifold to convey water from the ballast tank 310*a* to a first port of the valve 440*a*, and from a second port of the valve 440*a* to an aperture 530, which may be similar to the apertures 520. Likewise, a second pair of channels may be formed to convey water from the profile tank 310*b* to a first port of the valve 440*b*, and from a second port of the valve 440*b* to another aperture 530.

As the manifold 600 and the bottom manifold have complex designs, they may be manufactured from multiple parts which are assembled together. Preferably, though, the manifolds or portions thereof are manufactured using new techniques such as 3-D printing.

Figure 7:
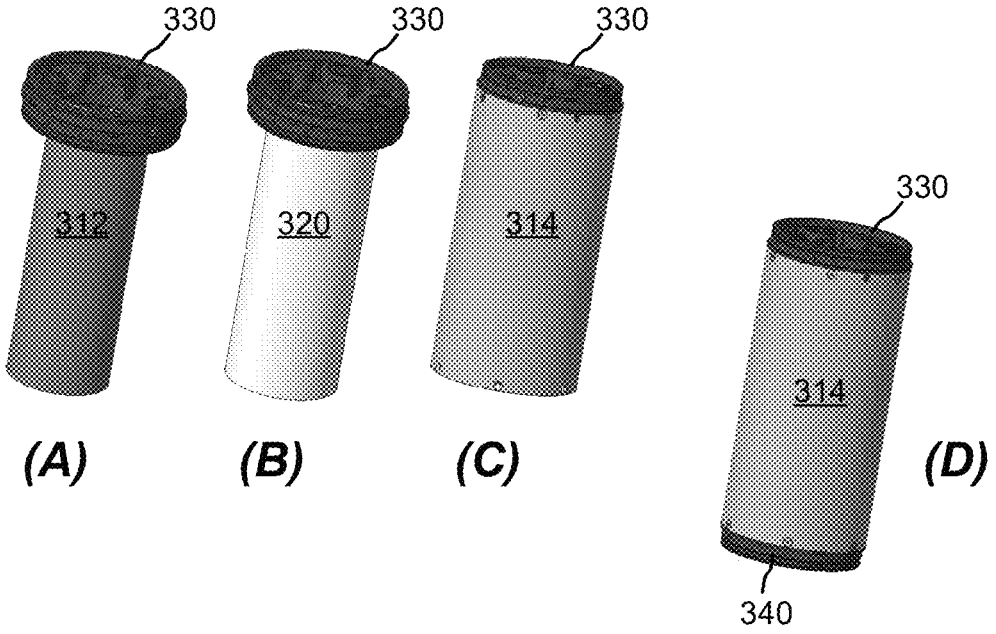
FIG. 7 is a series of views showing an example order of assembly of the variable buoyancy device of FIG. 3.

FIG. 7 shows an example sequence which may be used for assembling the variable buoyancy device 300. Assembly may begin at (A), by attaching the internal wall 312 to the top piece 330. As shown, wall 312 may be realized as a cylinder having a round cross-section. Wall 312 may attach to the top piece 330 via channels formed within an underside of the top piece 330. One or more O-rings may be used at the connection to prevent leaks. O-rings may also be used for attaching each of the additional walls.

At (B), wall 320 is attached to the top piece 330, e.g., in a similar way, with wall 320 surrounding wall 312. Walls 312 and 320 thus form concentric cylinders. An elongated annular space is formed between walls 312 and 320, which will eventually realize the profiling tank 310*b*.

At (C), outside wall 314 is attached to the top piece 330 and fastened in place, e.g., using screws, rivets, or other fasteners. Wall 314 laterally surrounds wall 320 and forms another concentric cylinder with walls 312 and 320. Another elongated annular space is formed between walls 314 and 320, which will eventually realize the ballast tank 310*a*.

At (D), the bottom piece 340 is attached, with walls 312, 320, and 314 attaching to the bottom piece 340 as they did to the top piece 330, for example. Completion of the ballast tank 310*a* and the profile tank 310*b* is thus achieved. Valves, pressure sensors, and other hardware, as illustrated in FIGS. 5 and 6, may be added to complete the assembly.

Figure 8:
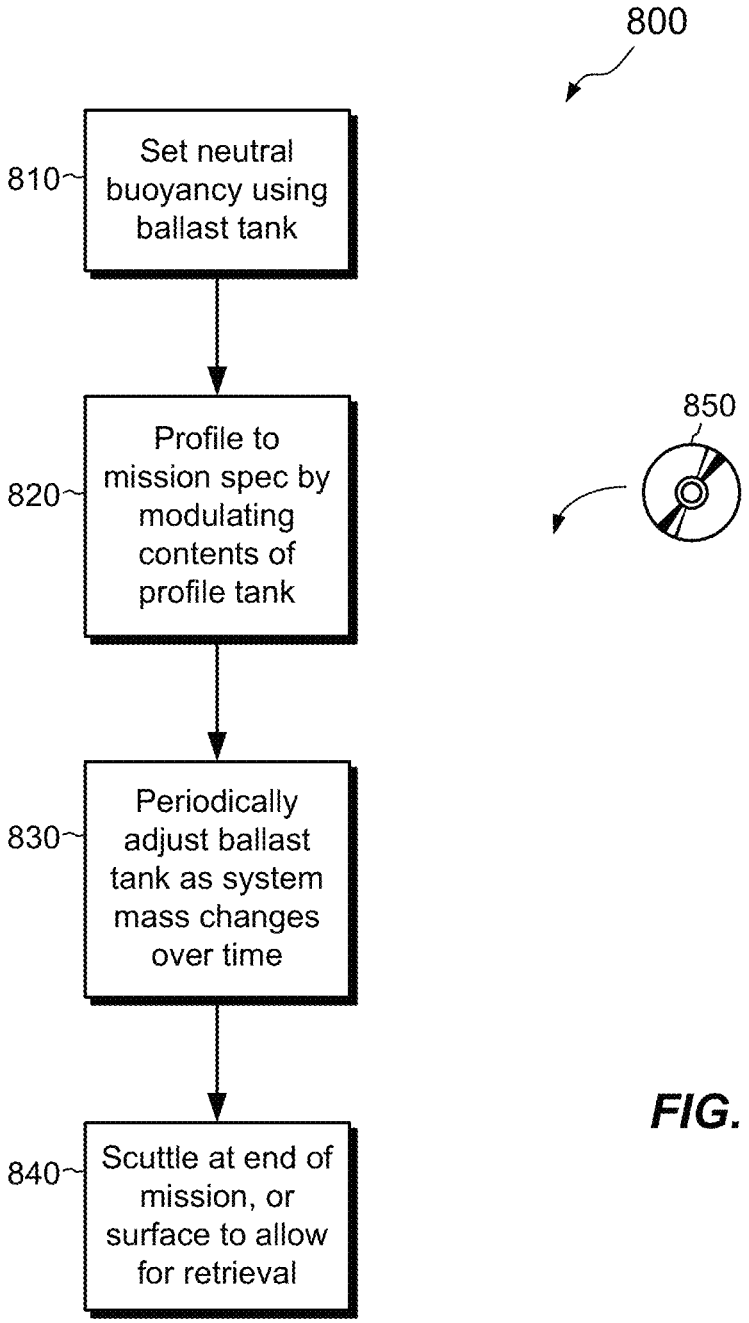
FIG. 8 is a flowchart showing an example method of changing buoyancy of a device.

FIG. 8 shows an example method 800 that may be carried out in connection with the variable buoyancy device 300. The method 800 is typically performed, for example, by the controller 220 executing software that resides in its memory. The various acts of method 800 may be ordered in any suitable way.

At 810, the controller 220 operates the valves to set neutral buoyancy of the sonde 110 using the ballast tank 310*a*. To this end, the controller may configure the valves to start filling the ballast tank 310*a* with water. For example, controller 220 opens valves 420*b* and 440*a* in timed increments until the sonde 110 just begins to sink. At this point, the sonde 110 has achieved neutral buoyancy. Owing to the closed, rigid design of the variable buoyancy device 300, the sonde 110 substantially maintains this neutral buoyancy independent of depth.

At 820, the controller 220 begins performing profiling cycles by modulating the contents of the profile tank 310*b*. For example, the controller 220 directs the variable buoyancy device 300 to decrease buoyancy by opening valves 430*b* and 440*b*, e.g., in a pulsed manner, causing the sonde 110 to sink. Once the desired depth is achieved, the controller 220 may open valves 430*a* and 440*b* (with valve 430*b* closed), causing some volume of water to be displaced with gas and increasing the buoyancy of the sonde 110. Depending on the amount of water displaced, the sonde 110 may slow its descent, stop descending, or begin to ascend. The controller 220 may use pulsed increments to vary buoyancy of the profile tank 310*b*. Each time the sonde surfaces, the sonde may transmit measurements to a base station, if desired.

The controller 220 may continue in this fashion to achieve a specified number of profiling cycles. If it is desired to wait between successive cycles, the controller 220 may direct the variable buoyancy device 300 to sink the sonde 110 to depths at which sunlight is unable to reach. At such depths, biofouling is minimized and optimal operation of the sonde 110 is likely to be preserved.

At 830, the controller 220 may periodically adjust the ballast tank 310*a* to reestablish neutral buoyancy. For example, as profiling proceeds some mass of gas is typically released into the environment 202, causing the container 410 to become lighter and thus the sonde 110 to become more buoyant. Adjustments of the ballast tank 310*a* may therefore be needed to compensate for the changes in buoyancy consequent to profiling. Adjustments to the ballast tank 310*a* may also be desirable for other reasons, such as when the salinity and/or temperature of water in the environment 202 around the sonde 110 changes significantly.

At 840, once the specified number of profiling cycles has been achieved and the mission is complete, the controller 220 may direct the variable buoyancy device 300 to scuttle the sonde 110, e.g., by opening all of the valves 420, 430, and 440 and allowing all the gas to escape. As an alternative to scuttling, the controller 220 may instead direct the sonde 110 to surface, such that the sonde 110 may be retrieved and possibly reused.

Figure 9:
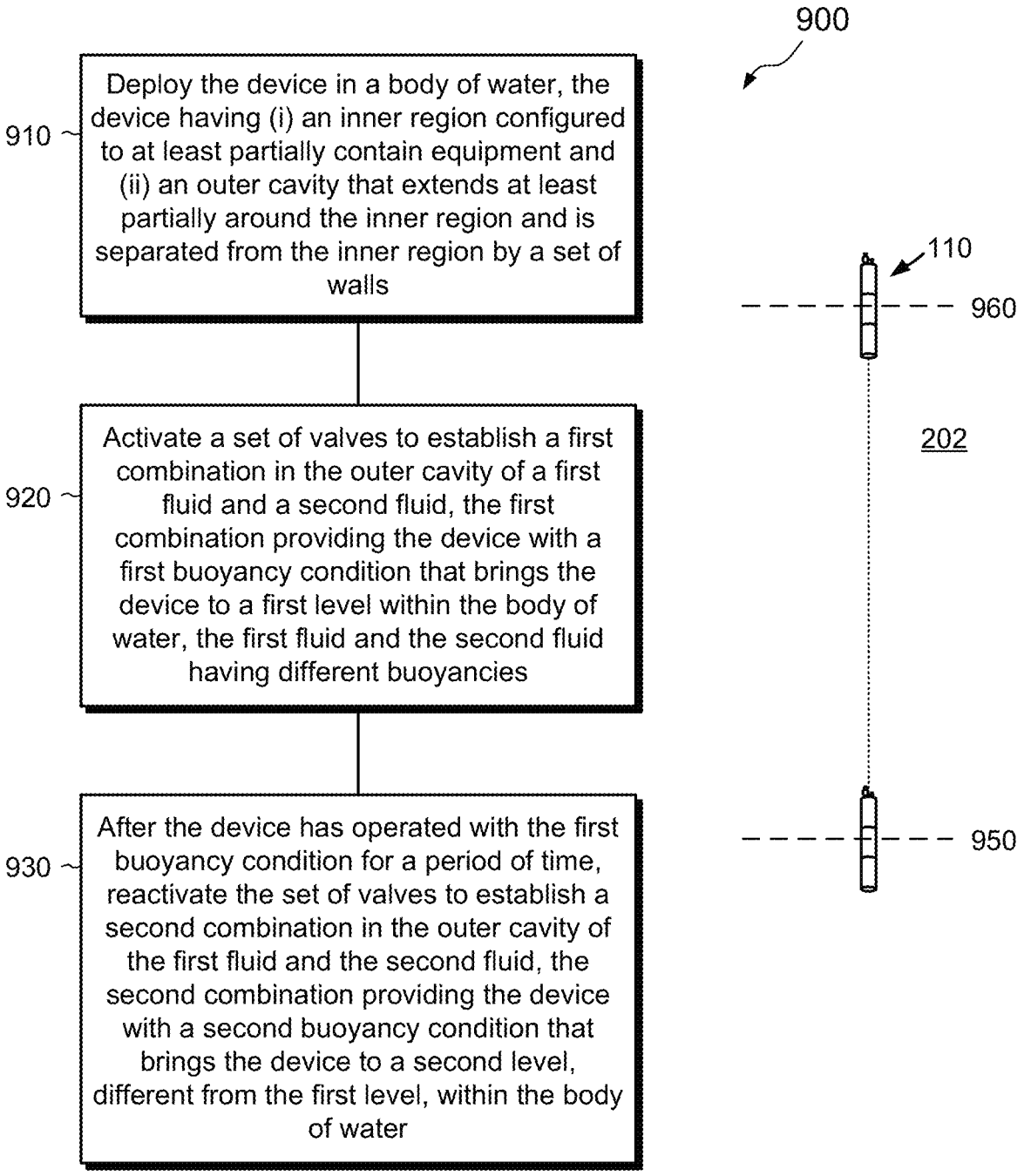
FIG. 9 is a flowchart showing an example method of using the variable buoyancy device of FIG. 3.

FIG. 9 shows an example method 900 of changing the buoyancy of a device. The method 900 may be carried out in connection with the sonde 110 and provides a high-level summary of some of the features described above. Also, the method 900 may be performed with either of the variable buoyancy modules 200 or 300. The various acts of method 900 may be ordered in any suitable way.

At 910, a device, such as sonde 110 having a variable buoyancy module, is deployed in a body of water 202. The device has (i) an inner region 208 or 308 configured to at least partially contain equipment (such as container 250 or 410, controller 220, and so forth) and (ii) an outer cavity 210 or 310 that extends at least partially around the inner region and is separated from the inner region by a set of walls, such as wall 212 or 312.

At 920, a set of valves is activated to establish a first combination in the outer cavity 210 or 310 of a first fluid 210*a* and a second fluid 210*b*. The first combination provides the device with a first buoyancy condition that brings the device 110 to a first level 950 within the body of water 202, the first fluid 210*a* and the second fluid 210*b* having different buoyancies.

At 930, after the device 110 has operated with the first buoyancy condition for a period of time, the set of valves is reactivated to establish a second combination in the outer cavity 210 or 310 of the first fluid and the second fluid. The second combination provides the device 110 with a second buoyancy condition that brings the device to a second level 960, different from the first level 950, within the body of water 202.

Improved techniques have been described that involve a variable buoyancy device 200 or 300 having an inner region 208 or 308 and an outer cavity 210 or 310. The outer cavity 210 or 310 extends at least partially around the inner region and is adapted to contain fluids 210*a* and 210*b*, such as a liquid and a gas, the relative proportions of which can be varied to vary buoyancy. The inner region provides an advantageous location for housing equipment, while the outer cavity provides a significant volume for achieving a wide range of buoyancy adjustments. The improved techniques enable the variable buoyancy device 200 or 300 to have a non-intrusive form factor (e.g., a slim or streamline body) with gas and/or liquid held efficiently in the outer cavity outside the inner region.

Having described certain embodiments, numerous alternative embodiments or variations can be made. For example, disclosed embodiments use combinations of ambient water and CO2 to establish different levels of buoyancy. The invention is not limited to these fluids, however. Also, embodiments have been disclosed in connection with a sonde 110. Other embodiments may employ the disclosed variable buoyancy devices with other equipment, however, such as submersible buoys, vehicles, probes, and the like. In some examples, a source of gas may take forms other than a container 250 or 410 of compressed gas. For example, gas may be created on demand, e.g., via a chemical reaction caused by exposing a substrate, such as one containing aluminum, to water.

Further, although features have been shown and described with reference to particular embodiments hereof, such features may be included and hereby are included in any of the disclosed embodiments and their variants. Thus, it is understood that features disclosed in connection with any embodiment are included in any other embodiment.

Further still, the improvement or portions thereof may be embodied as a computer program product including one or more non-transient, computer-readable storage media, such as a magnetic disk, magnetic tape, compact disk, DVD, optical disk, flash drive, solid state drive, SD (Secure Digital) chip or device, Application Specific Integrated Circuit (ASIC), Field Programmable Gate Array (FPGA), and/or the like (shown by way of example as medium 850 in FIG. 8). Any number of computer-readable media may be used. The media may be encoded with instructions which, when executed on one or more computers or other processors, perform the process or processes described herein. Such media may be considered articles of manufacture or machines, and may be transportable from one machine to another.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Also, a "set of" elements can describe fewer than all elements present. Thus, there may be additional elements of the same kind that are not part of the set. Further, ordinal expressions, such as "first," "second," "third," and so on, may be used as adjectives herein for identification purposes. Unless specifically indicated, these ordinal expressions are not intended to imply any ordering or sequence. Thus, for example, a "second" event may take place before or after a "first event," or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Also, and unless specifically stated to the contrary, "based on" is intended to be nonexclusive. Thus, "based on" should not be interpreted as meaning "based exclusively on" but rather "based at least in part on"

unless specifically indicated otherwise. Although certain embodiments are disclosed herein, it is understood that these are provided by way of example only and should not be construed as limiting.

Those skilled in the art will therefore understand that various changes in form and detail may be made to the embodiments disclosed herein without departing from the scope of the following claims.

What is claimed is:

1. A variable buoyancy device, comprising:

an inner region configured to at least partially contain equipment;

an outer cavity that extends completely around the inner region and is separated from the inner region by a set of walls;

a set of valves; and a controller coupled to the set of valves, the controller constructed and arranged to:

activate the set of valves to establish a first combination of a first fluid and a second fluid in the outer cavity, the first combination providing the device with a first buoyancy condition; and reactivate the set of valves to establish a second combination of the first fluid and the second fluid in the outer cavity, the second combination providing the device with a second buoyancy condition, the first fluid and the second fluid having different buoyancies.

2. The variable buoyancy device of claim 1, wherein the set of valves includes:

a first valve coupled between the outer cavity and an environment of the device, the first fluid obtained from the environment of the device; and a second valve coupled between the outer cavity and a source of the second fluid.

3. The variable buoyancy device of claim 2, wherein the first fluid comprises a liquid and the second fluid comprises a gas.

4. The variable buoyancy device of claim 3, wherein the source of the second fluid includes a container of compressed gas.

5. The variable buoyancy device of claim 3, wherein the outer cavity extends at least partially along the device lengthwise.

6. The variable buoyancy device of claim 5, wherein the outer cavity has a closed top and an open bottom open to the environment of the device.

7. The variable buoyancy device of claim 5, wherein the outer cavity includes a first region and a second region that provide respective enclosed spaces, the first region and the second region configured to contain respective combinations of the first fluid and the second fluid.

8. The variable buoyancy device of claim 7, wherein the set of valves is configured to independently control the respective combinations in the first region and the second region.

9. The variable buoyancy device of claim 8, wherein the first region is external to the second region and is larger in volume than the second region.

10. The variable buoyancy device of claim 7, wherein the outer cavity has an annular cross-section over at least a portion of its length, and wherein the first region and the second region are separated at least in part by a cylindrical wall within the outer cavity.

11. The variable buoyancy device of claim 7, wherein the source of the second fluid includes a container of compressed gas, the container at least partially disposed in the inner region as equipment of the device.

12. A sonde, comprising multiple modules arranged end-to-end, the modules including a variable buoyancy module, the variable buoyancy module including:

an inner region configured to at least partially contain equipment;

an outer cavity that extends completely around the inner region and is separated from the inner region by a set of walls;

a set of valves; and a controller coupled to the set of valves, the controller constructed and arranged to:

activate the set of valves to establish a first combination of a first fluid and a second fluid in the outer cavity, the first combination providing the sonde with a first buoyancy condition; and reactivate the set of valves to establish a second combination of the first fluid and the second fluid in the outer cavity, the second combination providing the sonde with a second buoyancy condition, the first fluid and the second fluid having different buoyancies.

13. A method of changing buoyancy of a device, the method comprising:

deploying the device in a body of water, the device having (i) an inner region configured to at least partially contain equipment and (ii) an outer cavity that extends completely around the inner region and is separated from the inner region by a set of walls;

activating a set of valves to establish a first combination in the outer cavity of a first fluid and a second fluid, the first combination providing the device with a first buoyancy condition that brings the device to a first level within the body of water, the first fluid and the second fluid having different buoyancies; and after the device has operated with the first buoyancy condition for a period of time, reactivating the set of valves to establish a second combination in the outer cavity of the first fluid and the second fluid, the second combination providing the device with a second buoyancy condition that brings the device to a second level, different from the first level, within the body of water.

14. The method of claim 13, wherein the first fluid is water provided from the body of water, wherein activating the set of valves causes a volume of water from the body of water to enter the outer cavity, wherein the second fluid is gas provided from a container of compressed gas, and wherein reactivating the set of valves causes a quantity of gas from the container to enter the outer cavity and a quantity of water to be displaced from the outer cavity.

15. The method of claim 14, wherein the outer cavity includes first and second regions that provide respective enclosed spaces, and wherein the method further comprises:

establishing a ballast setting of the device by providing a set combination of water and gas in the first region of the outer cavity; and varying a depth of the device in the body of the water by varying a combination of water and gas in the second region of the outer cavity while maintaining constant the set combination of water and gas in the first region.

16. The method of claim 15, wherein providing the set combination includes establishing neutral buoyancy of the device in the body of water.

17. The method of claim 16, wherein providing the set combination includes introducing water into the first region by:

opening a first valve coupled between the first region and the body of water; and opening a second valve coupled between an upper portion of the first region and the body of water.

18. The method of claim 15, wherein establishing the ballast setting of the device includes introducing gas into the first region by:

opening a first valve coupled between the first region and the body of water; and opening a third valve coupled between the first region and the container of compressed gas.

19. The method of claim 15, wherein varying the depth of the device further includes increasing the buoyancy of the device by:

opening a fourth valve coupled between a lower portion of the second region and the body of water; and opening a fifth valve coupled between the second region and the container of compressed gas, wherein opening the fourth valve and the fifth valve displaces a volume of water in the second region with a volume of gas.

20. The method of claim 19, wherein varying the depth of the device includes decreasing the buoyancy of the device by:

opening the fourth valve; and opening a sixth valve coupled between the second region and the body of water, wherein opening the fourth valve and the sixth valve displaces a volume of gas in the second region with a volume of water.

* * * * *